US009949596B2

(12) United States Patent
Hoesman

(10) Patent No.: US 9,949,596 B2
(45) Date of Patent: Apr. 24, 2018

(54) BATHING ASSISTANCE ASSEMBLY

(71) Applicant: Andrew Hoesman, Yorktown, IN (US)

(72) Inventor: Andrew Hoesman, Yorktown, IN (US)

( * ) Notice: Subject to any disclaimer, the term of this patent is extended or adjusted under 35 U.S.C. 154(b) by 52 days.

(21) Appl. No.: 15/131,567

(22) Filed: Apr. 18, 2016

(65) Prior Publication Data

US 2017/0296003 A1 Oct. 19, 2017

(51) Int. Cl.

| | |
|---|---|
| ***A47C 3/00*** | (2006.01) |
| ***A47K 3/12*** | (2006.01) |
| ***A47C 7/00*** | (2006.01) |
| ***A47C 3/40*** | (2006.01) |
| ***A47C 7/62*** | (2006.01) |

(52) U.S. Cl.

CPC ..... *A47K 3/122* (2013.01); *A47C 3/40* (2013.01); *A47C 7/004* (2013.01); *A47C 7/62* (2013.01)

(58) Field of Classification Search

CPC ..... A47K 3/122; A47C 3/40; A47C 3/004; A47C 3/62

USPC ..... 297/310; 4/579, 578.1, 571.1, 560.1

See application file for complete search history.

(56) References Cited

U.S. PATENT DOCUMENTS

| | | | | |
|---|---|---|---|---|
| 2,645,781 | A * | 7/1953 | Mover | A47K 3/127 297/352 |
| 4,183,579 | A * | 1/1980 | Gonzalez y. Rojas | A47C 9/025 248/171 |
| 4,498,204 | A * | 2/1985 | Warner | A47K 3/003 4/254 |
| 4,987,912 | A * | 1/1991 | Taylor | A61H 3/00 135/67 |
| 5,097,542 | A | 3/1992 | Roesler | |
| 5,491,850 | A * | 2/1996 | Kiester | A47K 3/127 4/572.1 |
| 5,561,868 | A | 10/1996 | Campbell | |
| 5,606,751 | A * | 3/1997 | Baker | A47K 3/122 4/560.1 |
| 5,682,626 | A * | 11/1997 | Banks, Jr. | A47K 3/122 4/541.5 |
| 5,822,809 | A | 10/1998 | Gallo | |
| 5,903,935 | A | 5/1999 | Huelke | |
| 5,940,900 | A * | 8/1999 | Wells | A47K 3/127 297/353 |
| 6,067,671 | A * | 5/2000 | Ginder | A47K 3/282 4/560.1 |
| 6,381,772 | B1 | 5/2002 | Dawson | |
| 6,408,456 | B1 * | 6/2002 | Fike | A47K 3/122 4/560.1 |
| 6,842,919 | B2 * | 1/2005 | Wilson | A47K 3/282 297/180.15 |
| 7,448,097 | B2 | 11/2008 | Cancian | |
| D611,715 | S | 3/2010 | Werschmidt | |

(Continued)

FOREIGN PATENT DOCUMENTS

| | | |
|---|---|---|
| EP | 1894553 | 9/2006 |

*Primary Examiner* — Jose V Chen

(57) ABSTRACT

A bathing assistance assembly includes a chair that may be removably positioned within a shower. The chair may support a user thereby facilitating the user to bathe. The chair includes a post and the post has an adjustable height. The post includes a plurality arms that are movably coupled to the post. A selected one of the arms engages the shower and the selected arm inhibits the chair from rotating about the post. A harness is removably coupled to the chair and the harness may be worn by the user thereby facilitating the user to be secured to the chair.

15 Claims, 5 Drawing Sheets

(56) References Cited

U.S. PATENT DOCUMENTS

| | | | | |
|---|---|---|---|---|
| 8,181,285 | B1 * | 5/2012 | Jackson | A47K 3/122 297/16.1 |
| 8,677,520 | B2 * | 3/2014 | Storm | A61G 5/1002 297/45 |
| 8,876,204 | B1 * | 11/2014 | Jewett | A47C 7/62 297/188.08 |
| 2002/0032925 | A1 * | 3/2002 | Stein | A47K 3/127 4/579 |
| 2010/0281611 | A1 * | 11/2010 | Veltri | A61H 35/006 4/541.1 |
| 2011/0232665 | A1 * | 9/2011 | Barnett, Jr. | A45B 7/00 132/200 |

* cited by examiner

BATHING ASSISTANCE ASSEMBLY

BACKGROUND OF THE DISCLOSURE

Field of the Disclosure

The disclosure relates to bathing devices and more particularly pertains to a new bathing device for assisting a physically disabled person with bathing.

SUMMARY OF THE DISCLOSURE

An embodiment of the disclosure meets the needs presented above by generally comprising a chair that may be removably positioned within a shower. The chair may support a user thereby facilitating the user to bathe. The chair includes a post and the post has an adjustable height. The post includes a plurality arms that are movably coupled to the post. A selected one of the arms engages the shower and the selected arm inhibits the chair from rotating about the post. A harness is removably coupled to the chair and the harness may be worn by the user thereby facilitating the user to be secured to the chair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
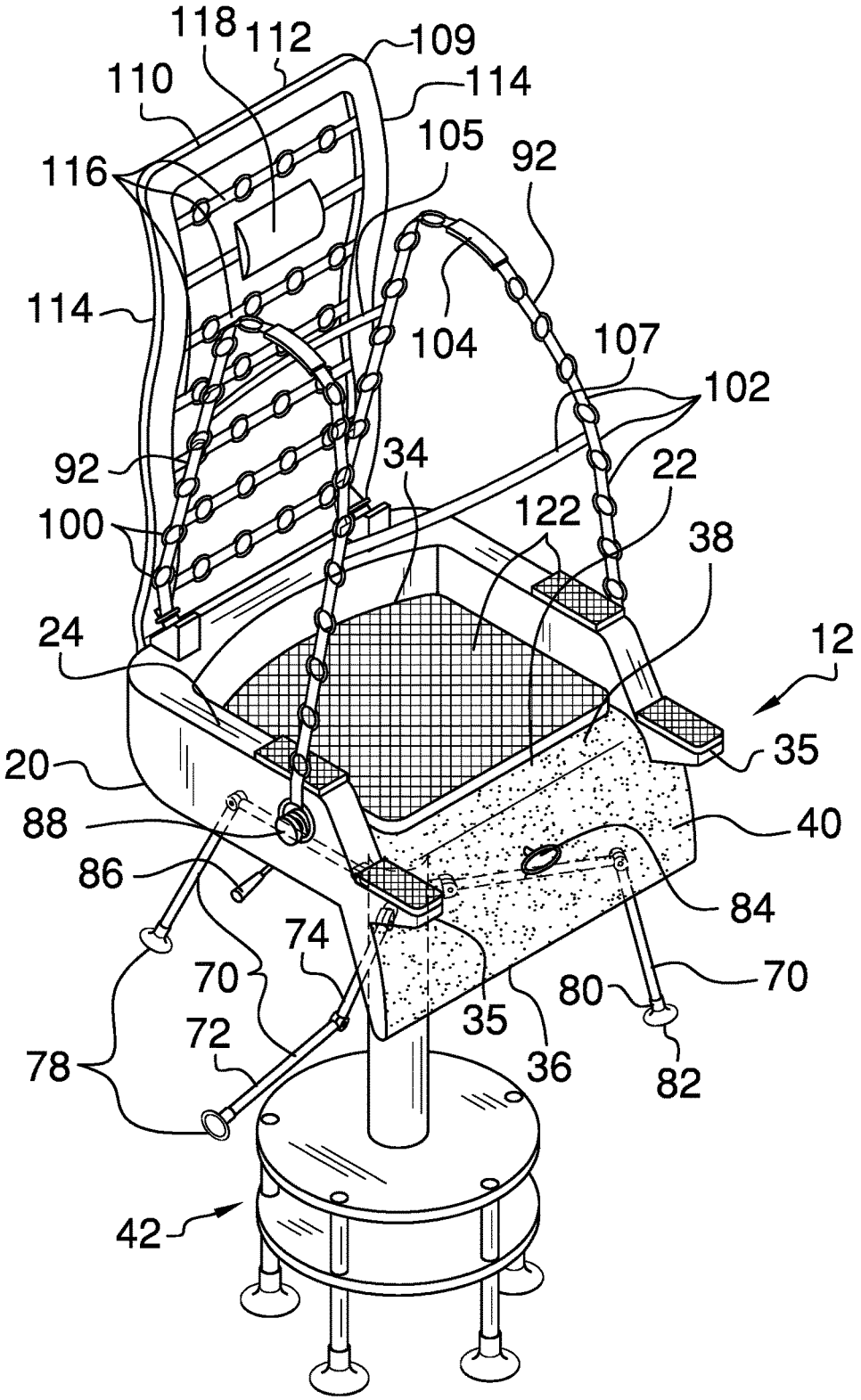
FIG. 1 is a top perspective view of a bathing assistance assembly according to an embodiment of the disclosure.
Figure 2:
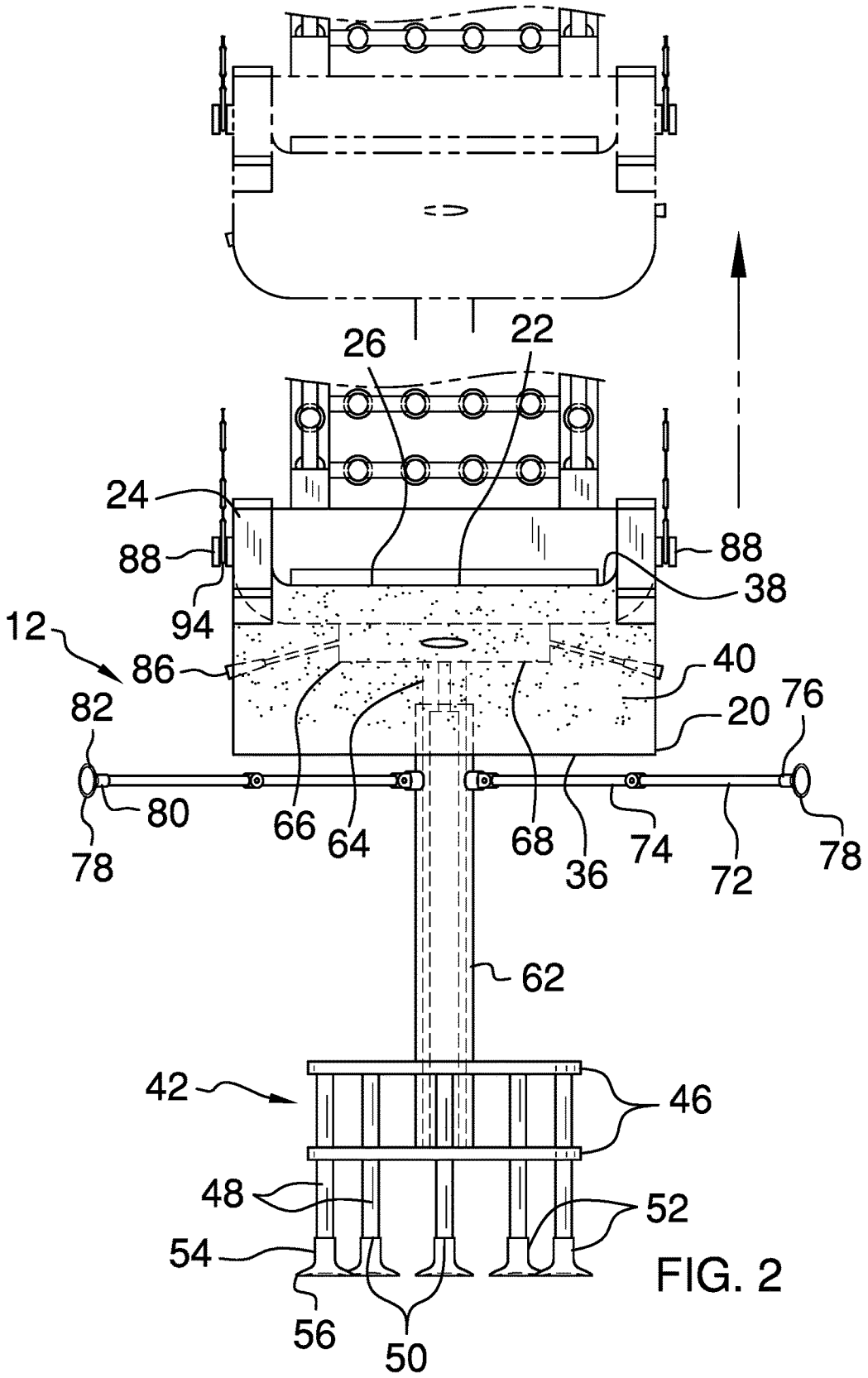
FIG. 2 is a front view of an embodiment of the disclosure.
Figure 3:
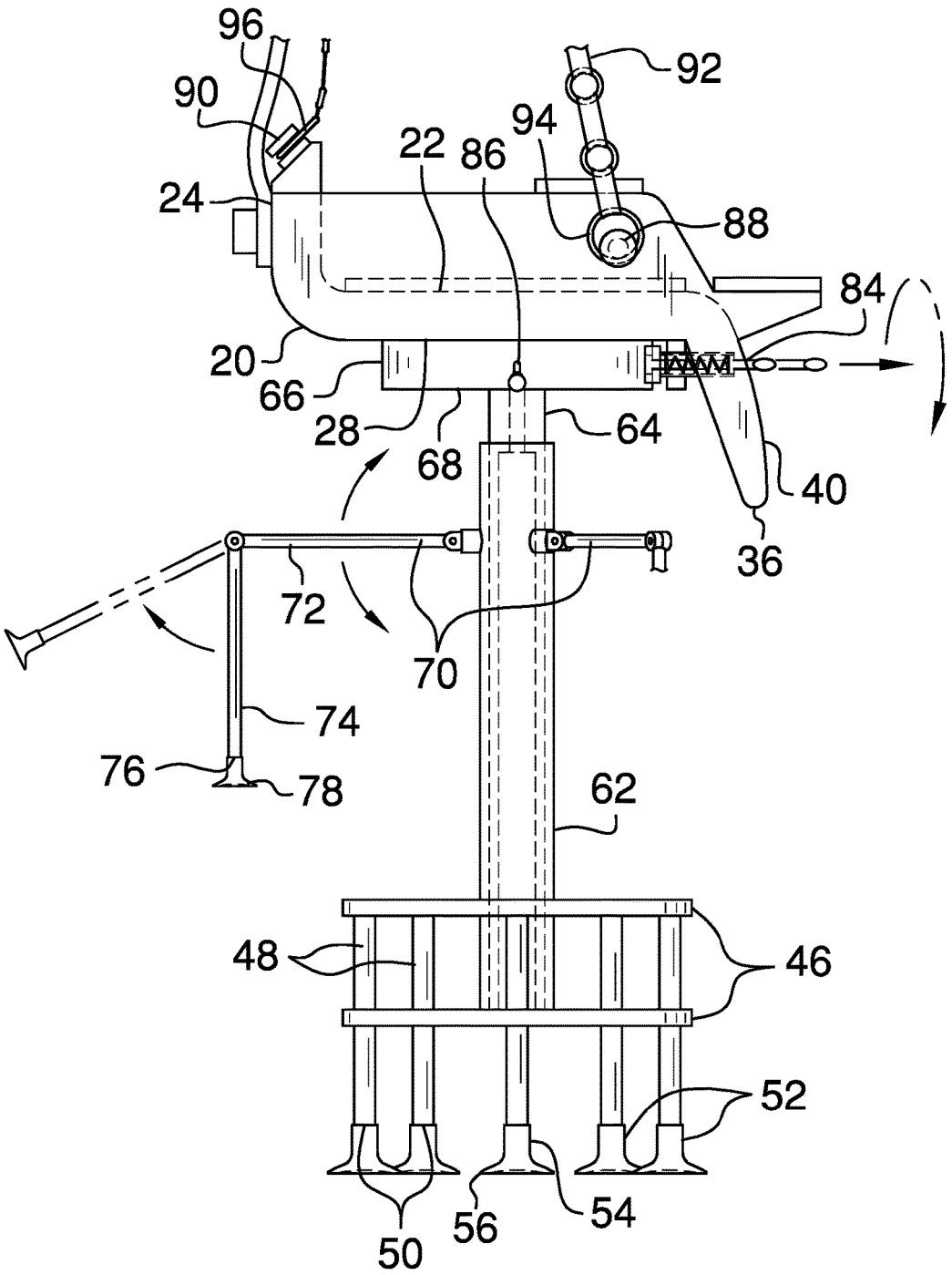
FIG. 3 is a right side view of an embodiment of the disclosure.
Figure 4:
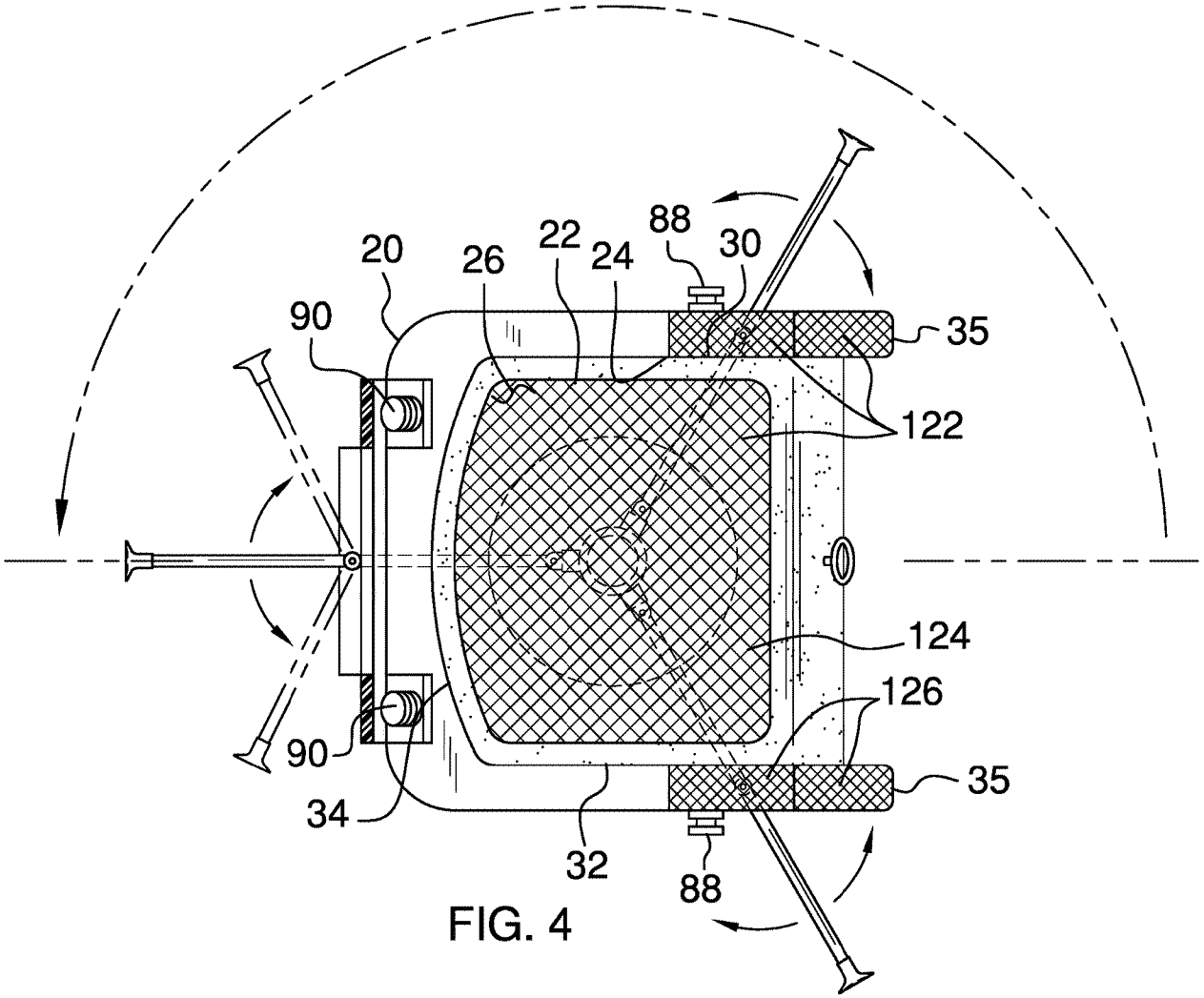
FIG. 4 is a top view of an embodiment of the disclosure.
Figure 5:
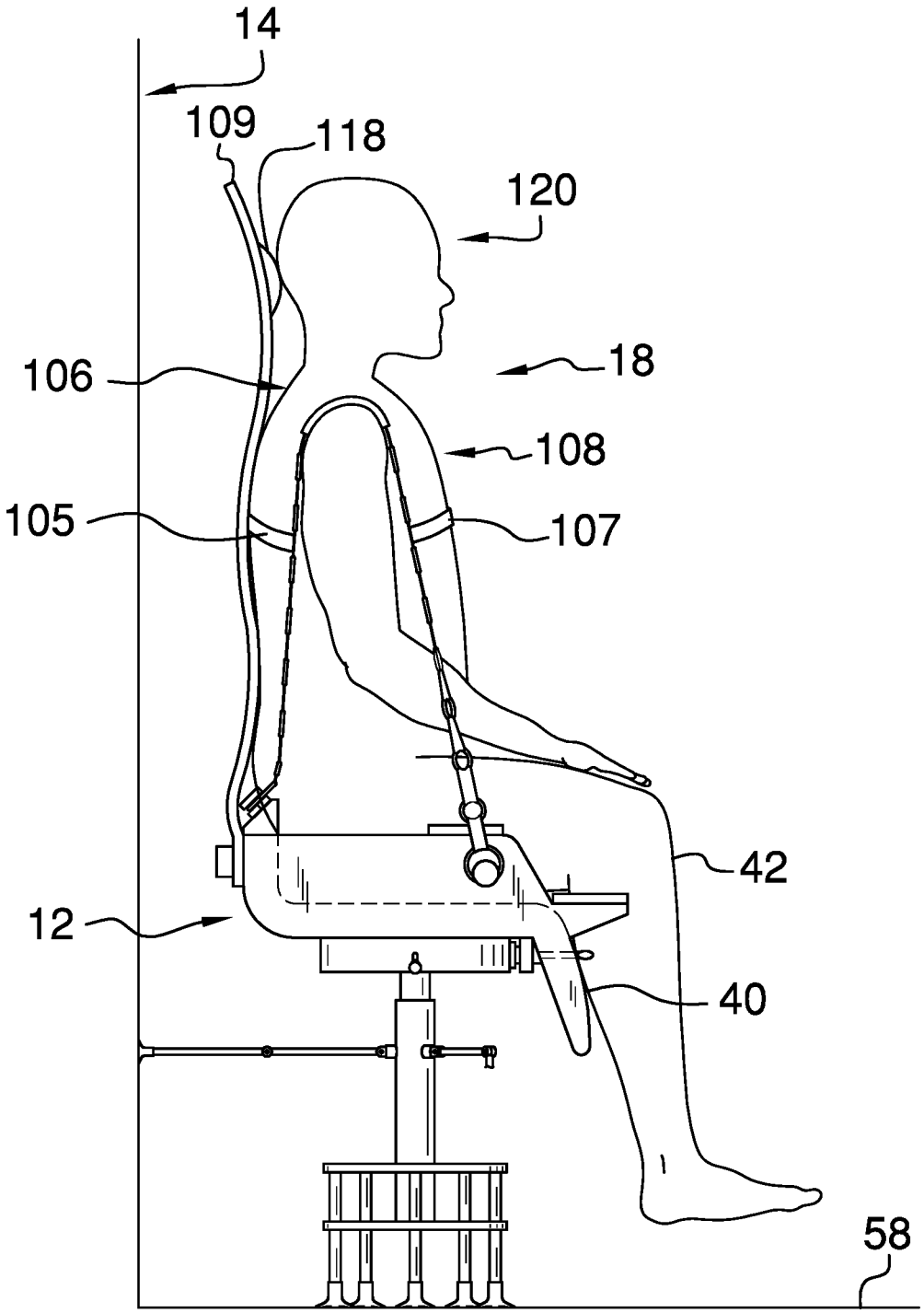
FIG. 5 is a perspective in-use view of an embodiment of the disclosure.

With reference now to the drawings, and in particular to FIGS. 1 through 5 thereof, a new bathing device embodying the principles and concepts of an embodiment of the disclosure and generally designated by the reference numeral 10 will be described.

As best illustrated in FIGS. 1 through 5, the bathing assistance assembly 10 generally comprises a chair 12 that may be removably positioned within a shower 14. The shower 14 may be a shower, a tub, or any fixture associated with bathing. The chair 16 may support a user 18 thereby facilitating the user 18 to bathe. The user 18 may be an elderly person, a physically disabled person or other person needing assistance while bathing.

The chair 12 comprises a seat 20 that has a basal wall 22 and a peripheral wall 24 extending upwardly from the basal wall 22. The basal wall 22 has a top surface 26, a bottom surface 28, a first lateral edge 30, a second lateral edge 32, a back edge 34 and a front edge 36. The top surface 26 may support the user 18 and the top surface 26 is textured. Thus, the top surface 26 inhibits the user 18 from slipping on the seat 20.

The peripheral wall 24 is coextensive with each of the first lateral edge 30, the second lateral edge 32 and the back edge 34. The peripheral wall 24 extends forwardly from each of the first lateral edge 30 and the second lateral edge 32 to define a pair of extensions 35. Each of the extensions 35 may be gripped while the user 18 is seating themselves on the seat 20. The basal wall 22 has a bend 38 thereon and the bend 38 extends between the first lateral edge 30 and the second lateral edge 32. The front edge 36 is directed downwardly from the basal wall 22 to define a vertical portion 40 of the seat 20. The vertical portion 40 may have legs 42 of the user 18 resting thereon when the user 18 sits on the seat 20.

A base 44 is provided and the base 44 comprises a pair of plates 46. The plates 46 are spaced apart from each other. The base 44 includes a plurality of legs 48 extending between each of the plates 46. The legs 48 are spaced apart from each other and are distributed around the plates 46. Each of the legs 48 has a distal end 50 with respect to the plates 46.

A plurality of first couplers 52 is provided and each of the first couplers 52 is coupled to the distal end 50 of an associated one of the legs 48. Each of the first couplers 52 includes a body 54 and a peripheral edge 56. The peripheral edge 56 flares outwardly from the body 54 such that each of the first couplers 52 forms a suction cup. Each of the first couplers 52 may suctionally engage a bottom wall 58 of the shower 14.

The post 60 is coupled between the seat 20 and the base 44. The post 60 extends through each of the plates 46. The post 60 has a first portion 62 that is slidably coupled to a second portion 64. Thus, the post 60 has a telescopically adjustable height. The post 60 may comprise a hydraulic piston or the like.

A disk 66 is coupled to the bottom surface 28 of the seat 20. The disk 66 has a lower side 68. The post 60 is coupled to the lower side 68 and the post 60 is centrally positioned on the disk 66. The disk 66 inhibits the seat 20 from tilting on the post 60 when the user 18 sits on the seat 20.

A plurality of arms 70 is provided and each of the arms 70 has a first portion 72 that is hingedly coupled to a second portion 74. The first portion 72 of each of the arms 70 is hingedly coupled to the post 60. The arms 70 are spaced apart from each other and distributed around the post 60. The arms 70 may be spaced one hundred twenty degrees apart from each other with respect to the post 60. Each of the arms 70 is positioned closer to the seat 20 than the base 44. The second portion 74 of each of the arms 70 has a distal end 76 with respect to the post 60.

A plurality of second couplers 78 is provided. Each of the second couplers 78 is coupled to the distal end 76 of an associated one of the arms 70. Each of the second couplers 78 has a body 80 and a peripheral edge 82. The peripheral edge 82 corresponding to each of the second couplers 78 flares outwardly with respect to the body 80 corresponding to each of the second couplers 78. Thus, each of the second couplers 78 forms a suction cup. The second coupler 78 corresponding to a selected one of the arms 70 may suctionally engage a vertical wall 84 of the shower 14 thereby inhibiting the chair 12 from tipping.

A rotate lever 84 extends through the vertical portion 40 of the seat 20 and the disk 66. The rotate lever frictionally engages the post 60. The rotate lever 84 may be manipulated and the rotate lever 84 is biased to engage the post 60 such that the seat 20 is inhibited from rotating on the post 60. The rotate lever 84 is urged to disengage the post 60 such that the seat 20 is rotatable about the post 60. The seat 20 is positioned at a selected point on the post 60 and the rotate lever 84 is released. Thus, the seat 20 is retained at the selected point.

A lift lever 86 is coupled to and extends away from the disk 66. The lift lever 86 may be manipulated. The second portion 64 of the post 60 slides within the first portion 62 of the post 60 when the lift lever 86 is manipulated. The lift lever 86 is manipulated and the seat 20 is positioned at a selected height. The lift lever 86 is released and the seat 20 is retained at the selected height.

A plurality of first knobs 88 is provided. Each of the first knobs 88 is coupled to the peripheral wall 24 of the seat 20 corresponding to an associated one of the first lateral edge 30 and the second lateral edge 32. A plurality of second knobs 90 is provided. Each of the second knobs 90 is coupled to the peripheral wall 24 corresponding to the back edge 34. The second knobs 90 are spaced apart from each other.

A pair of straps 92 is provided and each of the straps 92 has a first end 94 and a second end 96. The first end 94 of each of the straps 92 is matable with an associated one of the first knobs 88. The second end 96 of each of the straps 92 is matable with an associated one of the second knobs 90. Thus, each of the straps 92 may be worn over an associated shoulder 98 of the user 18 when the user 18 sits on the seat 20.

Each of the straps 92 may comprise an alternating sequence of rings 100 and sections 102. Each of the rings 100 facilitates a fluid to pass through the rings 100. The ring 100 corresponding to the first end 94 of each of the straps 92 may engage the associated first knob 88. The ring 100 corresponding to the second end 96 of each of the straps 92 may engage the associated second knob 90. The sections 102 of each of the straps 92 may be comprised of a resiliently stretchable material. A pair of pads 104 is provided and each of the pads 104 is coupled to an associated one of the straps 92. The pads 104 are centrally located on the straps 92 thereby enhancing comfort of the straps 92 on the user's shoulders 98.

A first strip 105 extends between the straps 92. The first strip 105 is positioned closer to the second end 96 than the first end 94. Thus, the first strip 105 extends across a back 106 of the user 18 when the user 18 wears the straps 92. A second strip 107 extends between the straps 92. The second strip 107 is positioned closer to the first end 94 than the second end 96. Thus, the second strip 107 extends across a chest 108 of the user 18 when the user 18 wears the straps 92.

The chair 12 includes a backrest 109 that is coupled to the seat 20. The backrest 109 is positioned to extend upwardly from the back edge 34 of the seat 20. Thus, the backrest 109 may support the user 18 when the user 18 sits in the seat 20. The backrest 109 may include a frame 110. The frame 110 may have a central member 112 extending between a pair of outer members 114. The outer members 114 may be spaced apart from each other such that the frame 110 has a U-shape. Each of the outer members 114 may be coupled to the seat 20 having the central member 112 being spaced from the seat 20.

Each of the outer members 114 may undulate between the seat 20 and the central member 112. Thus, each of the outer members 114 may conform to curvature of the user's back 106 thereby enhancing comfort of the backrest 109. A second set of the straps 116 may be provided. Each of the second set of straps 116 may be coupled to and extend between each of the outer members 114. The second straps 116 may be spaced apart from each other and be distributed along the outer members 114. A pillow 118 may be coupled to the backrest 109 to cushion the user's head 120 when the user 18 sits in the chair 12.

A plurality of pads 122 is provided. Each of the pads 122 is coupled to the seat 20. The plurality of pads 122 includes a seat pad 124 that is positioned on the top surface 26 of the basal wall 22. Thus, the user 18 may sit on the seat pad 124. The plurality of pads 122 includes a set of edge pads 126. Each of the edge pads 126 is positioned on the peripheral wall 24 of the seat 20. The edge pads 126 are spaced apart from each other and distributed on the peripheral wall 24 and the pair of extensions 35.

In use, the chair 12 is positioned in the shower 14 and each of the first couplers 52 suctionally engages the bottom wall 58 of the shower 14. The selected arm 70 is extended toward the vertical wall 84 of the shower 14. The second coupler 78 corresponding to the selected arm 70 suctionally engages the vertical wall 84 of the shower 14. Thus, the chair 12 is inhibited from tipping.

The lift lever 86 is manipulated and the seat 20 is positioned at a selected height thereby facilitating the user 18 to sit on the seat 20. Each of the straps 92 is manipulated to extend over the user's shoulders 98 and each of the straps 92 is coupled to the associated first 88 and second 90 knobs. The user 18 bathes while the user 18 is seated on the seat 20. The lift lever 86 is manipulated to adjust the height of the seat 20. The rotate lever 84 is manipulated to rotate the seat 20 on the post 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bathing assistance assembly comprising:

a chair being configured to be removably positioned within a shower, said chair being configured to support a user thereby facilitating the user to bathe, said chair including a post, said post having an adjustable height, said post including a plurality arms being movably coupled to said post, a selected one of said arms being configured to engage the shower wherein each of said arms inhibits said chair from rotating about said post;

a harness being removably coupled to said chair wherein said harness is configured to be worn by the user thereby facilitating the user to be secured to said chair; and a base comprising a pair of plates, said plates being spaced apart from each other, said base including a plurality of legs extending between each of said plates, said legs being spaced apart from each other and distributed around said plates, each of said legs having a distal end with respect to said plates.

2. The assembly according to claim 1, wherein said chair comprises a seat having a basal wall and a peripheral wall extending upwardly from said basal wall, said basal wall having a top surface, a bottom surface, a first lateral edge, a second lateral edge, a back edge and a front edge, said top surface being configured to support the user, said peripheral wall being coextensive with each of said first lateral edge, said second lateral edge and said back edge, said peripheral wall extending forwardly from each of said first lateral edge and said second lateral edge to define a pair of extensions wherein each of said extensions is configured to be gripped.

3. The assembly according to claim 2, wherein said basal wall has a bend thereon, said bend extending between said first lateral edge and said second lateral edge such said front edge is directed downwardly from said basal wall to define a vertical portion of said seat, said vertical portion being configured to have legs of the user resting thereon when the user sits on said seat.

4. The assembly of claim 1, further comprising:

said chair comprising:

a seat having a basal wall and a peripheral wall extending upwardly from said basal wall, said basal wall having a top surface, a bottom surface, a first lateral edge, a second lateral edge, a back edge and a front edge, said top surface being configured to support the user, said peripheral wall being coextensive with each of said first lateral edge, said second lateral edge and said back edge, said peripheral wall extending forwardly from each of said first lateral edge and said second lateral edge to define a pair of extensions wherein each of said extensions is configured to be gripped, said basal wall having a bend thereon, said bend extending between said first lateral edge and said second lateral edge such said front edge is directed downwardly from said basal wall to define a vertical portion of said seat, said vertical portion being configured to have legs of the user resting thereon when the user sits on said seat, a plurality of first couplers, each of said first couplers being coupled to said distal end of an associated one of said legs, each of said first couplers including a body and a peripheral edge, said peripheral edge flaring outwardly from said body such that each of said first couplers forms a suction cup, each of said first couplers being configured to suctionally engage a bottom wall of the shower, said post being coupled between said seat and said base, said post extending through each of said plates, said post having a first portion being slidably coupled to a second portion such that said post has a telescopically adjustable height, a disk being coupled to said bottom surface of said seat, said disk having a lower side, said post being coupled to said lower side wherein said disk is configured to inhibit said seat from tilting on said post when the user sits on said seat, each of said arms having a first portion being hingedly coupled to a second portion, said first portion of each of said arms being hingedly coupled to said post, said arms being spaced apart from each other and distributed around said post, each of said arms being positioned closer to said seat than said base, said second portion of each of said arms having a distal end with respect to said post, a plurality of second couplers, each of said second couplers being coupled to said distal end of an associated one of said arms, each of said second couplers having a body and a peripheral edge, said peripheral edge corresponding to each of said second couplers flaring outwardly with respect to said body corresponding to each of said second couplers such that each of said second couplers forms a suction cup, said second coupler corresponding to a selected one of said arms being configured to suctionally engage a vertical wall of the shower thereby inhibiting said seat from rotating, a rotate lever extending through said vertical portion of said seat and engaging said post wherein said rotate lever is configured to be manipulated, said rotate lever being biased to engage said post such that said seat is inhibited from rotating on said post, said rotate lever being urged to disengage said post such that said seat is rotatable about said post, and a lift lever being coupled to and extending away from said disk wherein said lift lever is configured to be manipulated, said second portion of said post sliding within said first portion of said post when said lift lever is manipulated; and said harness comprising:

a plurality of first knobs, each of said first knobs being coupled to said peripheral wall of chair corresponding to an associated one of said first lateral edge and said second lateral edge, a plurality of second knobs, each of said second knobs being coupled to said peripheral wall corresponding to said back edge, said second knobs being spaced apart from each other, a pair of straps, each of said straps having a first end and a second end, said first end of each of said straps being matable with an associated one of said first knobs, said second end of each of said straps being matable with an associated one of said second knobs, each of said straps being configured to be worn over an associated shoulder of the user, a first strip extending between said straps, said first strip being positioned closer to said second end than said first end wherein said first strip is configured to extend across a back of the user when the user wears said straps, and a second strip extending between said straps, said second strip being positioned closer to said first end than said second end wherein said second strip is configured to extend across a chest of the user when the user wears said straps.

5. The assembly according to claim 1, further comprising a plurality of first couplers, each of said first couplers being coupled to said distal end of an associated one of said legs, each of said first couplers including a body and a peripheral edge, said peripheral edge flaring outwardly from said body such that each of said first couplers forms a suction cup, each of said first couplers being configured to suctionally engage a bottom wall of the shower.

6. The assembly according to claim 1, wherein:

said chair includes a seat; and said post is coupled between said seat and said base, said post extending through each of said plates, said post having a first portion being slidably coupled to a second portion such that said post has a telescopically adjustable height.

7. The assembly according to claim 1, further comprising:

a seat having a bottom surface; and a disk being coupled to said bottom surface of said seat, said disk having a lower side, said post being coupled to said lower side wherein said disk is configured to inhibit said seat from tilting on said post when the user sits on said seat.

8. A bathing assistance assembly comprising:

a chair being configured to be removably positioned within a shower, said chair being configured to support a user thereby facilitating the user to bathe, said chair including a post, said post having an adjustable height, said post including a plurality arms being movably coupled to said post, a selected one of said arms being configured to engage the shower wherein each of said arms inhibits said chair from rotating about said post;

a harness being removably coupled to said chair wherein said harness is configured to be worn by the user thereby facilitating the user to be secured to said chair;

said chair includes a seat and a base; and each of said arms has a first portion being hingedly coupled to a second portion, said first portion of each of said arms being hingedly coupled to said post, said arms being spaced apart from each other and distributed around said post, each of said arms being positioned closer to said seat than said base, said second portion of each of said arms having a distal end with respect to said post.

9. The assembly according to claim 8, further comprising a plurality of second couplers, each of said second couplers being coupled to said distal end of an associated one of said arms, each of said second couplers having a body and a peripheral edge, said peripheral edge corresponding to each of said second couplers flaring outwardly with respect to said body corresponding to each of said second couplers such that each of said second couplers forms a suction cup, said second coupler corresponding to a selected one of said arms being configured to suctionally engage a vertical wall of the shower thereby inhibiting said seat from tipping.

10. The assembly according to claim 1, further comprising:

a seat having a vertical portion;

a disk being coupled to said seat; and a rotate lever extending through said vertical portion of said seat and engaging said post wherein said rotate lever is configured to be manipulated, said rotate lever being biased to engage said post such that said seat is inhibited from rotating on said post, said rotate lever being urged to disengage said post such that said seat is rotatable about said post.

11. The assembly according to claim 1, further comprising:

a disk;

said post having a first portion and a second portion; and a lift lever being coupled to and extending away from said disk wherein said lift lever is configured to be manipulated, said second portion of said post sliding within said first portion of said post when said lift lever is manipulated.

12. A bathing assistance assembly comprising:

a chair being configured to be removably positioned within a shower, said chair being configured to support a user thereby facilitating the user to bathe, said chair including a post, said post having an adjustable height, said post including a plurality arms being movably coupled to said post, a selected one of said arms being configured to engage the shower wherein each of said arms inhibits said chair from rotating about said post, said chair comprising a seat having a basal wall and a peripheral wall extending upwardly from said basal wall, said basal wall having a top surface, a bottom surface, a first lateral edge, a second lateral edge, a back edge and a front edge, said top surface being configured to support the user, said peripheral wall being coextensive with each of said first lateral edge, said second lateral edge and said back edge, said peripheral wall extending forwardly from each of said first lateral edge and said second lateral edge to define a pair of extensions wherein each of said extensions is configured to be gripped;

a harness being removably coupled to said chair wherein said harness is configured to be worn by the user thereby facilitating the user to be secured to said chair;

a plurality of first knobs, each of said first knobs being coupled to said peripheral wall of chair corresponding to an associated one of said first lateral edge and said second lateral edge; and a plurality of second knobs, each of said second knobs being coupled to said peripheral wall corresponding to said back edge, said second knobs being spaced apart from each other.

13. The assembly according to claim 12, further comprising a pair of straps, each of said straps having a first end and a second end, said first end of each of said straps being matable with an associated one of said first knobs, said second end of each of said straps being matable with an associated one of said second knobs, each of said straps being configured to be worn over an associated shoulder of the user.

14. The assembly according to claim 13, further comprising a first strip extending between said straps, said first strip being positioned closer to said second end than said first end wherein said first strip is configured to extend across a back of the user when the user wears said straps.

15. The assembly according to claim 13, further comprising a second strip extending between said straps, said second strip being positioned closer to said first end than said second end wherein said second strip is configured to extend across a chest of the user when the user wears said straps.

* * * * *